US010192679B2

(12) United States Patent
Kano et al.

(10) Patent No.: US 10,192,679 B2
(45) Date of Patent: Jan. 29, 2019

(54) METHOD OF MANUFACTURING RARE EARTH MAGNET

(71) Applicant: TOYOTA JIDOSHA KABUSHIKI KAISHA, Toyota-shi, Aichi-ken (JP)

(72) Inventors: Akira Kano, Toyota (JP); Tetsuya Shoji, Toyota (JP); Osamu Yamashita, Toyota (JP); Daisuke Ichigozaki, Nissin (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 138 days.

(21) Appl. No.: 15/107,631

(22) PCT Filed: Dec. 19, 2014

(86) PCT No.: PCT/IB2014/002839

§ 371 (c)(1),
(2) Date: Jun. 23, 2016

(87) PCT Pub. No.: WO2015/097524

PCT Pub. Date: Jul. 2, 2015

(65) Prior Publication Data

US 2016/0336112 A1 Nov. 17, 2016

(30) Foreign Application Priority Data

Dec. 27, 2013 (JP) ..... 2013-271985

(51) Int. Cl.
*H01F 1/057* (2006.01)
*H01F 41/02* (2006.01)

(52) U.S. Cl.
CPC ..... *H01F 41/0266* (2013.01); *H01F 1/0576* (2013.01); *H01F 1/0577* (2013.01); *H01F 41/0273* (2013.01)

(58) Field of Classification Search
CPC .. H01F 1/0576; H01F 1/0577; H01F 41/0266; H01F 41/0273
See application file for complete search history.

(56) References Cited

U.S. PATENT DOCUMENTS

2014/0210582 A1 7/2014 Ozeki et al.
2014/0238553 A1 8/2014 Sakuma et al.
2014/0308441 A1* 10/2014 Shoji ..... H01F 1/0577 427/129

FOREIGN PATENT DOCUMENTS

CN 1799111 A 7/2006
EP 1189244 A2 3/2002
(Continued)

*Primary Examiner* — Colleen P Dunn
*Assistant Examiner* — Anthony M Liang
(74) *Attorney, Agent, or Firm* — Sughrue Mion, PLLC

(57) ABSTRACT

A method of manufacturing a rare earth magnet includes: preparing a powder by preparing a rapidly-solidified ribbon by liquid solidification, and by crushing the rapidly-solidified ribbon; manufacturing a sintered compact by press-forming the powder; and manufacturing a rare earth magnet by performing hot deformation processing on the sintered compact to impart anisotropy to the sintered compact. In this method, the rapidly-solidified ribbon is a plurality of fine crystal grains. The powder includes a RE-Fe—B main phase and a grain boundary phase of a RE-X alloy present around the main phase. RE represents at least one of Nd and Pr. X represents a metal element. A nitrogen content in the powder is adjusted to be at least 1,000 ppm and less than 3,000 ppm by performing at least one of the preparation of the powder and the manufacturing of the sintered compact in a nitrogen atmosphere.

2 Claims, 6 Drawing Sheets

(56) References Cited

FOREIGN PATENT DOCUMENTS

| | | | |
|---|---|---|---|
| EP | 2239747 | A1 | 10/2010 |
| JP | 2004-250781 | A | 9/2004 |
| JP | 2005-015886 | A | 1/2005 |
| JP | 2013-084802 | A | 5/2013 |
| JP | 2013-089687 | A | 5/2013 |
| WO | 2013/072728 | A1 | 5/2013 |

* cited by examiner

METHOD OF MANUFACTURING RARE EARTH MAGNET

BACKGROUND OF THE INVENTION

1. Field of the Invention

The present invention relates to a method of manufacturing a rare earth magnet.

2. Description of Related Art

Rare earth magnets made from rare earth elements such as lanthanoid are called permanent magnets and are used for driving motors of hybrid vehicles, electric vehicles, and the like as well as motors included in hard disks and MRIs.

As an index indicating magnet performance of these rare earth magnets, for example, remanent magnetization (remanent magnetic flux density) and coercive force may be used. Along with a decrease in the size of a motor and an increase in current density, the amount of heat generation increases, and thus the demand for high heat resistance has further increased in rare earth magnets to be used. Accordingly, one of the important research issues in this technical field is how to hold magnetic properties of a magnet when being used at a high temperature.

Examples of the rare earth magnets include commonly-used sintered magnets in which a grain size of crystal grains (main phase) constituting a structure thereof is about 3 μm to 5 μm; and nanocrystalline magnets in which crystal grains are refined into a nano grain size of about 50 nm to 300 nm. Among these, currently, nanocrystalline magnets have attracted attention because they can reduce the addition amount of expensive heavy rare earth elements while realizing the refinement of crystal grains or they do not need the addition of heavy rare earth element.

An example of a method of manufacturing a rare earth magnet will be briefly described. For example, a method of manufacturing a rare earth magnet (oriented magnet) is commonly used, this method including: rapidly solidifying Nd—Fe—B molten metal to obtain fine powder; press-forming the fine powder into a sintered compact; and performing hot deformation processing on this sintered compact so as to impart magnetic anisotropy thereto. Examples of the hot deformation processing include extrusion such as backward extrusion and forward extrusion; and upsetting (forging).

It is known that, during the hot deformation processing, oxygen contained in a magnet material deteriorates a Nd—Fe—B main phase, which causes a decrease in remanent magnetic flux density and coercive force. In addition, it is also known that, when a modified alloy is diffused in a grain boundary phase to recover the coercive force after the hot deformation processing, oxygen remaining in the grain boundary phase inhibits the infiltration of the modified alloy into the grain boundary phase.

On the other hand, regarding nitrogen contained in a magnet material, it is generally known that, when the oxygen content is suppressed, the nitrogen content is reduced along with oxygen, and an effect of the nitrogen content on the magnet material has yet to be actively studied.

Japanese Patent Application Publication No. 2013-89687 (JP 2013-89687 A) discloses a method of manufacturing a Nd—Fe—B rare-earth permanent magnet, the method including: dry-milling a magnet material in an atmosphere of a noble gas to obtain magnet powder; forming the magnet powder into a formed body in an atmosphere of a noble gas; and sintering the formed body at 800° C. to 1180° C., in which a remanent nitrogen concentration after sintering is 800 ppm or lower and more preferably 300 ppm or lower.

The manufacturing method disclosed in JP 2013-89687 A has a description regarding the nitrogen content, but the details thereof are not about an increase in nitrogen content for improving magnet performance but about suppression in the nitrogen content for improving the coercive force of the rare earth magnet.

In order for the manufactured rare earth magnet to have, high orientation, it is necessary to apply strong strains to a sintered compact during hot deformation processing. However, crystal orientation is disordered due to locally high stress generated during deformation, and this crystal orientation disorder causes a decrease in remanent magnetization.

The crystal orientation disorder under high stress during the hot deformation processing occurs for the following reasons. That is, typically, the hot deformation processing of a Nd—Fe—B rare earth magnet is performed by applying a stress of 100 MPa to 500 Mpa thereto in a temperature around 800° C. In this temperature range, a liquid phase (Nd-rich phase) appears in the grain boundary phase, and this liquid phase promotes the main phase (crystal) to rotate and move. However, due to the high stress which is applied to obtain high magnetic properties during the hot deformation processing, the liquid phase is pressed out, and a liquid-phase pool is locally formed. Due to this liquid-phase pool, an orientation alignment behavior such as rotation or movement of crystals is disturbed, which leads to orientation disorder of crystals around the liquid-phase pool.

Therefore, in order to reduce the liquid-phase pool, a method of reducing the applied stress during the hot deformation processing may be considered. However, in order to obtain high magnetic properties, it is necessary to apply a high stress. Therefore, a reduction in the applied stress is contradictory to the improvement of magnetic properties by the hot deformation processing. In addition, a magnet material is a brittle material and is likely to be cracked when being processed. Therefore, a process of reducing tensile stress is necessary in the hot deformation processing. For example, the application of high stress is inevitable during the above-described extrusion or upsetting (forging).

SUMMARY OF THE INVENTION

The invention has been made to provide a method of manufacturing a rare earth magnet, in which magnetic properties can be improved during hot deformation processing in which high stress is applied to a sintered compact in a high-temperature atmosphere.

According to an aspect of the invention, there is provided a method of manufacturing a rare earth magnet including: preparing a powder by preparing a rapidly-solidified ribbon by liquid solidification, and by crushing the rapidly-solidified ribbon; manufacturing a sintered compact by press-forming the powder; and manufacturing a rare earth magnet by performing hot deformation processing on the sintered compact to impart anisotropy to the sintered compact. In this method, the rapidly-solidified ribbon is a plurality of fine crystal grains. The powder includes a RE-Fe—B main phase and a grain boundary phase of a RE-X alloy present around the main phase. RE represents at least one of Nd and Pr. X represents a metal element. In addition, a nitrogen content in the powder is adjusted to be at least 1,000 ppm and less than 3,000 ppm by performing at least one of the preparation of the powder and the manufacturing of the sintered compact in a nitrogen atmosphere.

In the manufacturing method according to the aspect, manufacturing steps are performed, the manufacturing steps including: the preparation of powder by liquid solidification (hereinafter, also referred to as "first step"); the manufacturing of a sintered compact by press-forming the powder (hereinafter, also referred to as "second step"); and the manufacturing of a rare earth magnet by performing hot deformation processing on the sintered compact (hereinafter, also referred to as "third step"). The nitrogen content in the powder is adjusted to be at least 1,000 ppm and less than 3,000 ppm by performing at least one of the first step and the second step among the manufacturing steps in a nitrogen atmosphere. That is, for example, unlike the idea disclosed in JP 2013-89687 A in which coercive force performance is improved by adjusting the nitrogen concentration to be 800 ppm or less, this method is to improve magnetic properties of a rare earth magnet such as coercive force and remanent magnetization, in particular, to improve remanent magnetization by adjusting the nitrogen content to be at least 1,000 ppm and less than 3,000 ppm which is higher than that in JP 2013-89687 A.

Here, "performing at least one of the preparation of the powder and the manufacturing of the sintered compact in a nitrogen atmosphere" represents any one of a method of performing only the preparation of the powder in a nitrogen atmosphere, a method of performing only the manufacturing of the sintered compact in a nitrogen atmosphere, and a method of performing both the preparation of the powder and the manufacturing of the sintered compact in a nitrogen atmosphere.

By heating the sintered compact through the hot deformation processing in the third step, a liquid phase (Nd-rich phase) appears in a grain boundary present between crystals constituting the sintered compact. When strong strains are applied in the hot deformation processing, this liquid phase has an auxiliary function during crystal growth (orientation) such as rotation or movement of crystals.

In the manufacturing method according to the aspect, by the material powder being nitrided to be at least 1,000 ppm and less than 3,000 ppm, even in a state where a liquid-phase pool is likely to be formed during the hot deformation processing of the sintered compact, a part of the liquid phase is cured by forming a nitride with nitrogen. Therefore, the liquid-phase pool, which may be formed during heating in the hot deformation processing, is suppressed, and conversely, the amount of the liquid phase appearing on the grain boundary can be decreased. By liquid-phase pool, which inhibits rotation, movement, or the like of crystals, being present in a small amount or being absent in the material powder, local crystal orientation disorder around the liquid-phase pool is suppressed, and thus crystal orientation is promoted in the entire region. Consequently, magnetic properties of the obtained rare earth magnet can be improved.

Here, in the manufacturing method according to the aspect of the invention, a grain size of the crushed powder may be adjusted to be in a range of 75 μm to 300 μm. In addition, an average grain size of the main phase constituting the sintered compact may be adjusted to be 300 nm or less. In a grain size range of less than 75 μm of the, crushed powder, a specific surface area and oxidizability increase due to the fine powder. Accordingly, it is difficult to adjust the oxygen content in a high-temperature atmosphere in which the manufacturing steps are performed. On the other hand, in a grain size range of more than 300 μm, there is a high possibility that the fluidity of the powder during the manufacture of the sintered compact may decrease, and the productivity may decrease.

In the first step, the powder for a rare earth magnet is prepared by preparing a rapidly-solidified ribbon, which is fine crystal grains, by liquid solidification and crushing the rapidly-solidified ribbon. The grain size range of this crushed powder is adjusted to be in, for example, the above-described range of 75 μm to 300 μm. For example, the powder having a grain size in the desired range is obtained by sieving the crushed powder. In the second step, this powder is filled into, for example, a die and is sintered while being compressed by a punch to be bulked. As a result, an isotropic sintered compact is obtained. An average grain size of the main phase (crystals) of the sintered compact is adjusted to be in, for example, the above-described range of 300 nm or less.

For example, this sintered compact has a metallographic structure that includes a RE-Fe—B main phase (RE: at least one of Nd and Pr, more specifically, one element or two or more elements selected from Nd, Pr, Nd—Pr) of a nanocrystalline structure and a grain boundary phase of an RE-X alloy (X: metal element) present around the main phase.

Regarding the performing of at least one of the first step and the second step in a nitrogen atmosphere, for example, the first step may be performed in a vacuum atmosphere, and the second step of manufacturing the sintered compact may be performed in a nitrogen atmosphere.

In addition, a content ratio of RE in the RE-Fe—B main phase (Re: at least one of Nd and Pr), which is to form a rare earth magnet material, may be 29 mass % to 32 mass %.

The reason is as follows. When the content ratio of RE is less than 29 mass %, cracking is likely to occur during the hot deformation processing, and thus orientation deteriorates. When the content ratio of RE is more than 32 mass %, the soft grain boundary absorbs strains of the hot deformation processing, orientation deteriorates, and the content of the main phase decreases. Therefore, remanent magnetization decreases.

Here, in the manufacturing method according to the aspect of the invention, the nitrogen content in the powder may be adjusted to be in a range of 1,000 ppm to 2,500 ppm.

As can be understood from the above description, in the method of manufacturing a rare earth magnet according to the aspect of the invention, the nitrogen content in the powder is adjusted to be at least 1,000 ppm and less than 3,000 ppm by performing at least one of the step of preparing the powder and the step of manufacturing the sintered compact among the manufacturing steps in a nitrogen atmosphere. As a result, the formation of the liquid-phase pool, which is likely to be formed during the hot deformation processing, is suppressed, crystal orientation can be promoted, and a rare earth magnet having superior magnetic properties can be manufactured.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 7A is an image when observed at a magnification of 10,000 times, and FIG. 7B is an image when observed at a magnification of 50,000 times;

FIG. 8A is an image when observed at a magnification of 10,000 times, and FIG. 8B is an image when observed at a magnification of 50,000 times.

DETAILED DESCRIPTION OF EMBODIMENTS

Figure 1A:
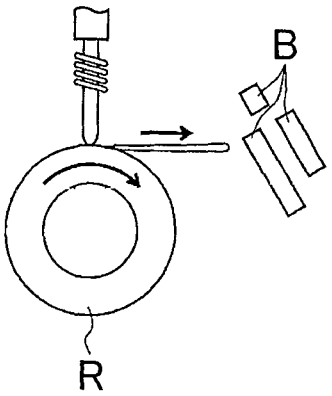
FIGS. 1A and 1B are schematic diagrams illustrating a first step and a second step, respectively, of a method of manufacturing a rare earth magnet according to an embodiment of the invention.

Hereinafter, an embodiment of a method of manufacturing a rare earth magnet according to the invention will be described with reference to the drawings. In example illustrated in the drawings, an extrusion punch having a, plate-shaped hollow portion is used for extrusion to which hot deformation processing is applied. In the example illustrated in the drawings, a processing method (backward extrusion) of manufacturing a plate-shaped oriented magnet is used, the method including: extruding a part of a sintered compact into the hollow portion of the above-described extrusion punch while compressing the sintered compact with the extrusion punch to reduce the thickness of the sintered compact In addition to the method of the example illustrated in the drawings, a processing method (forward extrusion) of manufacturing a plate-shaped oriented magnet, or upsetting (forging) may also be used. The forward extrusion includes: putting a sintered compact into a die having a plate-shaped hollow portion; and extruding a part of the sintered compact into the hollow portion of the die while compressing the sintered compact with a punch not having a hollow portion to reduce the thickness of the sintered compact.

(Embodiment of Method of Manufacturing Rare Earth Magnet)

Figure 1B:
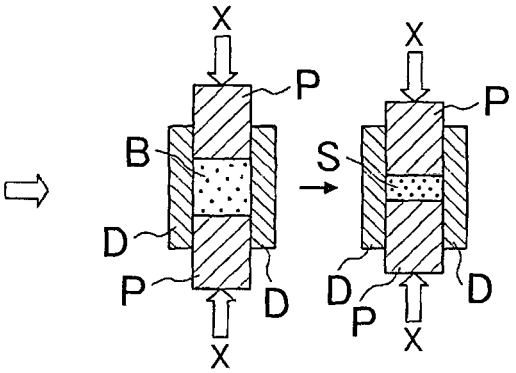
Figure 2:
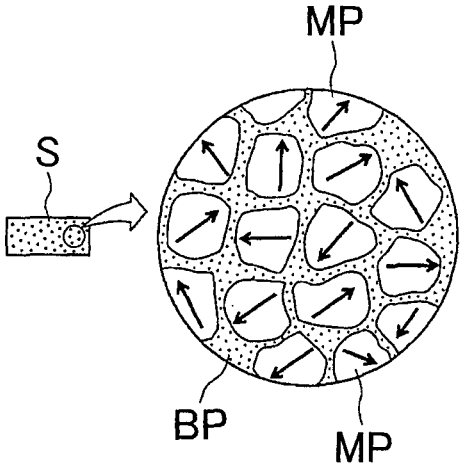
FIG. 2 is a diagram illustrating a microstructure of a sintered compact illustrated in FIG. 1B.
Figure 3:
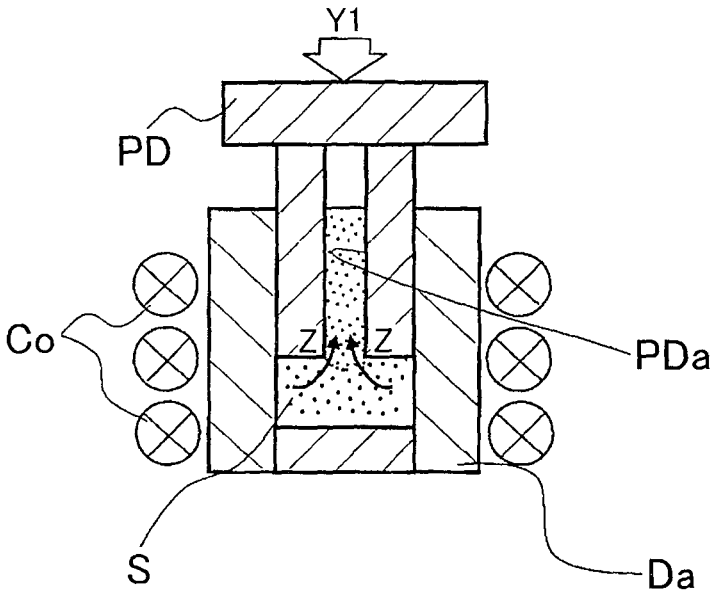
FIG. 3 is a diagram illustrating a third step following the second step illustrated in FIG. 1B.
Figure 4:
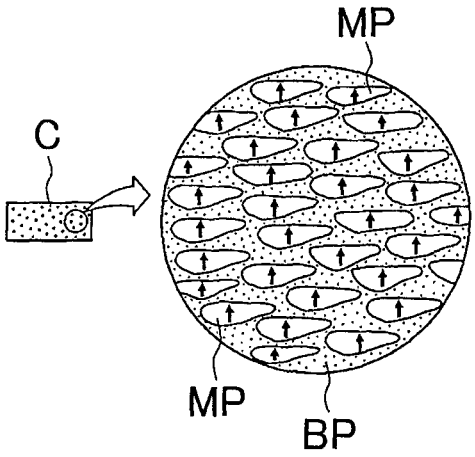
FIG. 4 is a diagram illustrating a microstructure of the manufactured rare earth magnet.

FIG. 1A is a schematic diagrams illustrating a first step of a method of manufacturing a rare earth magnet according to an embodiment of the invention, and FIG. 1B is a schematic diagram illustrating a second step thereof. FIG. 2 is a diagram illustrating a microstructure of a sintered compact illustrated in FIG. 1B. In addition, FIG. 3 is a diagram illustrating a third step following the second step illustrated in FIG. 1B. FIG. 4 is a diagram illustrating a microstructure of the manufactured rare earth magnet. A combination of the first to third steps may be regarded as a series of manufacturing steps.

In the manufacturing method according to the embodiment, as illustrated in FIG. 1A, in a furnace (not illustrated) in which the pressure is reduced to, for example, 50 kPa, an alloy ingot is melted by high-frequency induction heating using a single-roll melt spinning method, and molten metal having a composition of a rare earth magnet is injected to a copper roll R to prepare a rapidly-solidified ribbon B, and this rapidly-solidified ribbon B is crushed to prepare powder. A grain size range of the crushed powder is adjusted to be in a range of 75 μm to 300 μm (first step).

As illustrated in FIG. 1B, the crushed powder is filled into a cavity which is partitioned by a cemented carbide die D and a cemented carbide punch P sliding in a hollow portion of the cemented carbide die D. Next, the powder is heated at about 800° C. by causing a current to flow therethrough in a compression direction while being compressed with the cemented carbide punch P (X direction). As a result, a quadrangular prism-shaped sintered compact S is prepared, the sintered compact including: a Nd—Fe—B main phase (having an average grain size of 300 nm or less, for example, having a grain size of about 50 nm to 200 nm) of a nanocrystalline structure; and a grain boundary phase of a Nd—X alloy (X: metal element) present around the main phase (second step).

Here, the Nd—X alloy constituting the grain boundary phase is an alloy of Nd and at least one of Co, Fe, Ga, and the like and is in a Nd-rich state. For example, one alloy or a mixture of two or more alloys selected from among Nd—Co, Nd—Fe, Nd—Ga, Nd—Co—Fe, and Nd—Co—Fe—Ga may be used. In this case, it is preferable that the sintered compact be a bulk body having a density of 7.4 $g/cm^3$ or higher.

The nitrogen content in the powder is adjusted to be at least 1,000 ppm and less than 3,000 ppm by performing at least one of the two steps including the first step and the second step in a nitrogen atmosphere.

For example, only the first step may be performed in a nitrogen atmosphere, only the second step may be performed in a nitrogen atmosphere, or both the first and second steps may be performed in a nitrogen atmosphere. For example, a configuration may be adopted in which the first step is performed in a vacuum atmosphere and the second step of manufacturing the sintered compact S is performed in a nitrogen atmosphere.

As illustrated in FIG. 2, the sintered compact S has an isotropic crystal structure in which the grain boundary phase BP is filled between nanocrystalline grains MP (main phase).

Once the quadrangular prism-shaped sintered compact S is prepared, extrusion which is the hot deformation processing illustrated in FIG. 3, is performed thereon. As a result, a rare earth magnet C to which magnetic anisotropy is imparted as illustrated in FIG. 4 is manufactured.

Referring to FIG. 3 again, regarding the hot deformation processing, the sintered compact S is put into a die Da, and the die Da is heated by a high-frequency coil Co. Before the sintered compact S having a film is put into the die Da, a lubricant may be coated on an inner surface of the die Da or an inner surface of a plate-shaped hollow portion PDa of an extrusion punch PD.

The sintered compact S is compressed by the extrusion punch PD having the plate-shaped hollow portion PDa (Y1 direction), and a part of the sintered compact S is extruded into the plate-shaped hollow portion PDa while the thickness thereof is reduced by the above compression (Z direction).

A strain rate during the extrusion, which is the hot deformation processing, is adjusted to be 0.1/sec or higher. In addition, when the processing degree (compressibility) by the hot deformation processing is high, for example, when the compressibility is about 10% or higher, this hot deformation processing may be called high deformation. However, in the manufacturing method according to the embodiment, the hot deformation processing is performed in a processing rate range of about 60% to 80%.

By performing the hot deformation processing by the extrusion, in the manufactured rare earth magnet C, as illustrated in FIG. 4, the nanocrystalline grains MP have a flat shape, and the boundary surface which is substantially parallel to an anisotropic axis is curved or bent. This rare earth magnet has high magnetic anisotropy.

In the method of manufacturing a rare earth magnet illustrated in the drawings, the nitrogen content in the powder is adjusted to be at least 1,000 ppm and less than 3,000 ppm by performing at least one of the first step of preparing the powder and the second step of manufacturing the sintered compact S in a nitrogen atmosphere. As a result, the formation of the liquid-phase pool, which is likely to be formed during the hot deformation processing, is suppressed, crystal orientation can be promoted, and a rare earth magnet having superior magnetic properties can be manufactured.

The oriented magnet C illustrated in the drawing has a metallographic structure that includes a RE-Fe—B main phase (RE: at least one of Nd and Pr) and a grain boundary phase of an RE-X alloy (X: metal element) present around the main phase. In the oriented magnet C, a content ratio of RE is 29 mass %≤RE≤32 mass %, and an average grain size of the main phase of the manufactured rare earth magnet is preferably 300 nm or less. By adjusting the content ratio of RE to be in the above-described range, an effect of suppressing cracking during hot deformation processing can be further improved, and a high orientation degree can be secured. In addition, by adjusting the content ratio of RE to be in the above-described range, the size of the main phase at which high remanent magnetic flux density can be secured can be secured.

By performing the hot deformation processing in the third step, a rare earth magnet which is an oriented magnet is manufactured. In this case, a diffusion and infiltration treatment of a modified alloy may be performed on the oriented magnet to further improve the coercive force. Here, a modified alloy not having a heavy rare earth element may be used to reduce the manufacturing cost, and examples of the modified alloy include a Nd—Cu alloy, a Nd—Al alloy, a Pr—Cu, alloy, and a Pr—Al alloy. For example, the eutectic temperature of the Nd—Cu alloy is about 520° C., the eutectic temperature of the Pr—Cu alloy is about 480° C., the eutectic temperature of the Nd—Al alloy is about 640° C., and the eutectic temperature of the Pr—Al alloy is about 650° C. Since the eutectic temperatures of the above modified alloys are significantly lower than a range of 700° C. to 1000° C. in which crystal grains constituting the nanocrystalline magnet are coarsened, the modified alloys are particularly preferably used for a nanocrystalline magnet having a grain size in a range of 300 nm or less.

[Experiment for Specifying Relationship Between Nitrogen Content in Magnet Material Powder and Increased Amount in Remanent Magnetization of Rare Earth Magnet (Compared to Remanent Magnetization of Rare Earth Magnet in which Nitrogen Content was 0), and Results Thereof]

The present inventors manufactured rare earth magnets while changing the nitrogen content in the magnet material powder, and the remanent magnetization of each of the rare earth magnets was measured. In addition, an increased amount in the remanent magnetization of each of the rare earth magnets compared to the remanent magnetization of a rare earth magnet in which the nitrogen content was 0 was obtained. In this way, an experiment for specifying a relationship between the nitrogen content and an increased amount in remanent magnetization was performed.

(Method of Preparing Test Piece)

A method of preparing a rare earth magnet as a test piece was as follows. That is, magnet raw materials (an alloy composition was Fe-30Nd-0.93B-4Co-0.4Ga by mass %) were mixed in predetermined amounts, the mixture was melted in an Ar atmosphere, and the molten metal was injected from a ϕ0.8 mm orifice into a Cr-plated Cu rotating roll to be rapidly-solidified. As a result, a rapidly-solidified ribbon was manufactured. This rapidly-solidified ribbon was crushed using a cutter mill in an Ar atmosphere to obtain powder having a grain size of 0.3 mm or less as a magnet material.

The prepared powder was put into a cemented carbide mold having a size of 20 mm×20 mm×40 mm, and upper and lower portions thereof were sealed with a cemented carbide punch. This mold was set in a chamber, and the pressure thereof was reduced to $10^{-2}$ Pa and was returned to 0.1 MPa using $N_2$ gas. Next, the mold was heated to 650° C. by a high-frequency coil, was held at 650° C. for 0 minutes to 10 minutes, and was pressurized to 400 MPa by the upper and lower portions of the punch. After the pressurization, the mold was held for 60 seconds, and a sintered compact was pulled out from the mold. In this way, sintered compacts which were to form plural rare earth magnet precursors in which the nitrogen content was adjusted to be in a range of 200 ppm to 3,000 ppm were obtained.

Next, each of the sintered compacts was put into a mold, and the mold was heated by a high-frequency coil. Due to heat transfer from the mold, the sintered compact was heated to about 800° C., and backward extrusion was performed as the hot deformation processing at a processing rate of 70% and a stroke speed of 25 mm/s (a strain rate of about 1/s).

(Experiment Results)

Figure 5:
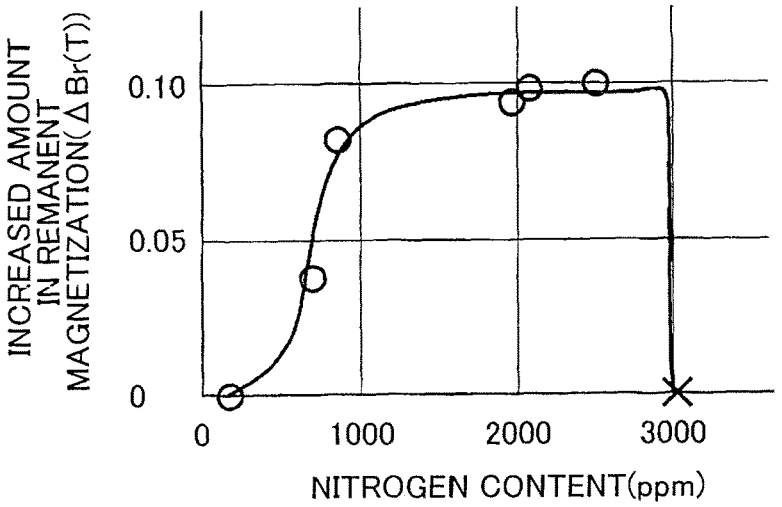
FIG. 5 is a graph illustrating the results of an experiment for specifying a relationship between the nitrogen content in magnet material powder and an increased amount in the remanent magnetization of a rare earth magnet (compared to the remanent magnetization of a rare earth magnet in which the nitrogen content was 0)

The experiment results are shown in FIG. 5. In FIG. 5, an inflection point was present at a nitrogen content of 1,000 ppm, an increased amount in remanent magnetization rapidly decreased in a range of lower than 1,000 ppm, and an increased amount in remanent magnetization was saturated at about 0.1 T in a range of 1,000 ppm or higher. At 3,000 ppm, deformability decreased by the liquid phase of the test piece being cured. As a result, plural cracks were formed during the back extrusion, and magnetic properties were not able to be confirmed.

From the experiment results, the following was found: the nitrogen content in the powder which is the magnet material is preferably 1,000 ppm; the upper limit of the nitrogen content was less than 3,000 ppm because, when the nitrogen content reaches 3,000 ppm, cracking occurs due to excessive curing. That is, it was found that the nitrogen content is preferably adjusted to be at least 1,000 ppm and less than 3,000 ppm. More preferably, the nitrogen content may be adjusted to be in a range of 1,000 ppm to 2,500 ppm.

(Regarding Relationship Between Nitrogen Atmosphere Holding Time and Nitrogen Content in Magnet Material Powder)

In addition, in this experiment, a relationship between a nitrogen atmosphere holding time and the nitrogen content in the magnet material powder was specified. Specifically, at a nitrogen concentration of 97 kPa in a nitrogen atmosphere, the nitrogen content was measured while changing the holding time to 0, 1, 2, 3, 5, and 10 minutes. The results are shown in FIG. 6.

Figure 6:
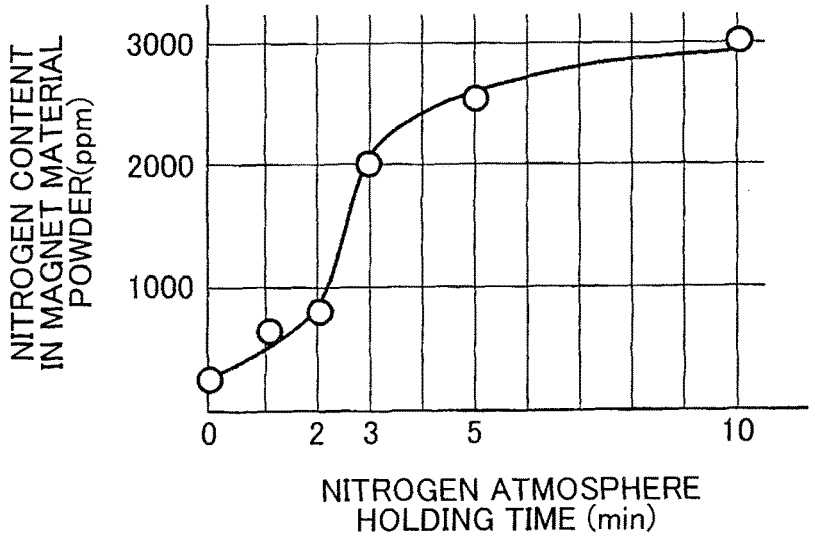
FIG. 6 is a graph illustrating the results of an experiment for specifying a relationship between a nitrogen atmosphere holding time and the nitrogen content in the magnet material powder.

In FIG. 6, the nitrogen content was 1,000 ppm or higher at a nitrogen atmosphere holding time of 2 to 3 minutes and was 3,000 ppm at a nitrogen atmosphere holding time of 10 minutes. It was found from the above results that the holding time in a nitrogen atmosphere having a nitrogen concentration of 97 kPa is preferably longer than 2 minutes and shorter than 10 minutes.

(Observation Results of SEM Images)

Figure 7A:
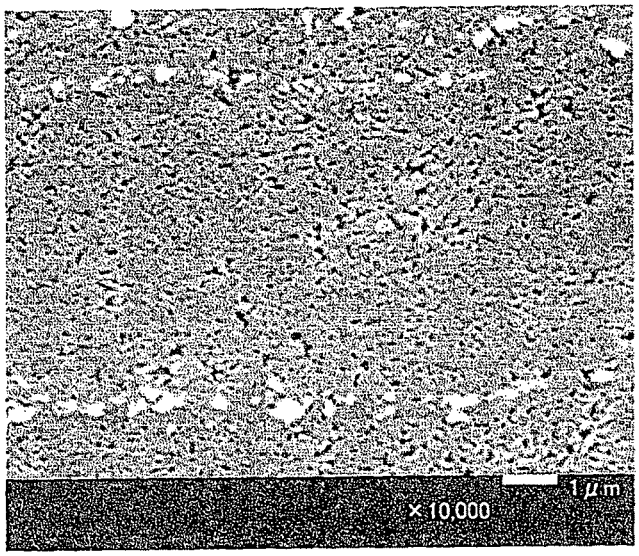
FIGS. 7A and 7B are SEM images which were obtained by observing a structure of a test piece in which the nitrogen content in the magnet material powder was 2,000 ppm.
Figure 7B:
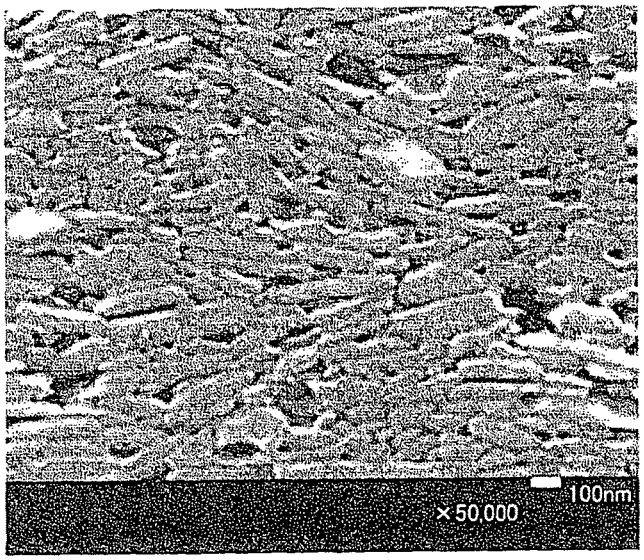

Further, in this experiment, a structure of a test piece in which the nitrogen content in the magnet material powder was 2,000 ppm and a structure of a test piece in which the nitrogen content in the magnet material powder was 200 ppm were observed with a SEM. Here, FIGS. 7A and 7B are SEM images which were obtained by observing the structure of the test piece in which the nitrogen content in the magnet material powder was 2,000 ppm, FIG. 7A is an image when observed at a magnification of 10,000 times, and FIG. 7B is an image when observed at a magnification of 50,000 times. In addition, FIGS. 8A and 8B are SEM images which were obtained by observing the structure of the test piece in which the nitrogen content in the magnet material powder was 200 ppm, FIG. 8A is an image when observed at a magnification of 10,000 times, and FIG. 8B is an image when observed at a magnification of 50,000 times.

In FIGS. 7A and 7B, in the test piece having a nitrogen content of 2,000 ppm which was at least 1,000 ppm and lower than 3,000 ppm, no liquid-phase pool was observed between crystals. Since the liquid-phase pool was not present between crystals, crystal orientation was promoted, and thus a rare earth magnet having superior magnetic properties was obtained due to a high orientation degree.

Figure 8A:
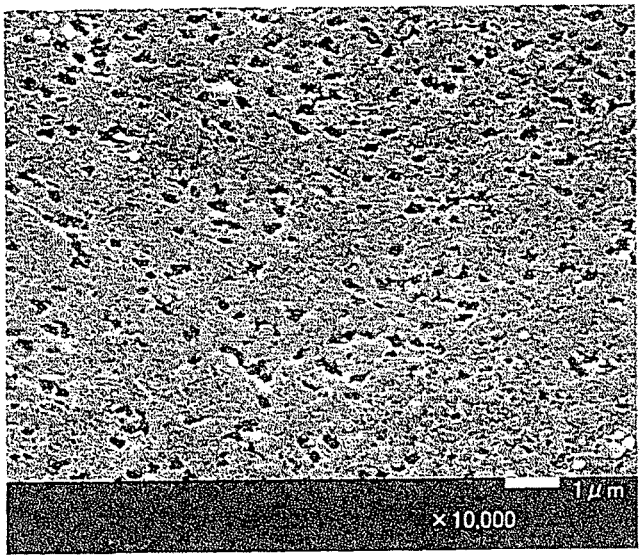
FIGS. 8A and 8B are SEM images which were obtained by observing a structure of a test piece in which the nitrogen content in the magnet material powder was 200 ppm.
Figure 8B:
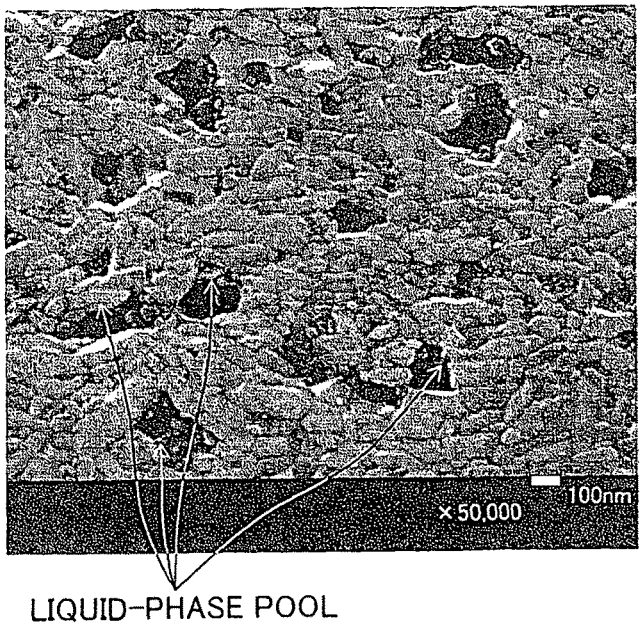

On the other hand, in FIGS. 8A and 8B, in the test piece having a nitrogen content of 200 ppm which was lower than 1,000 ppm, a large number of liquid-phase pools were observed between crystals. It was considered that, due to these liquid-phase pools, an orientation alignment behavior such as rotation or movement of crystals was disturbed, and magnetic properties were decreased due to orientation disorder of crystals around the liquid-phase pools.

[Experiment for Specifying Relationship Between Stress Applied During Hot Deformation Processing and Increased Amount in Magnetization (Increased Amount of Test Piece Having Nitrogen Content of 2,000 ppm Compared to Test Piece Having Nitrogen Content of 200 ppm), Results Thereof]

The present inventors further performed an experiment, in which the sintered compact in which the nitrogen content in the powder was 2,000 ppm and the sintered compact in which the nitrogen content in the powder was 200 ppm were selected from among the sintered compacts which were the precursors of the test pieces prepared in the above-described experiment, the following three types of hot deformation processing were performed on the respective sintered compacts to manufacture rare earth magnets, the remanent magnetizations of the respective rare earth magnets were measured, and an increased amount of the test piece having a nitrogen content of 2,000 ppm compared to the test piece having a nitrogen content of 200 ppm was specified.

A first processing method of the hot deformation processing was upsetting forging. In this processing, each of the sintered compacts was put into a mold, and the mold was heated by a high-frequency coil. Due to heat transfer from the mold, the sintered compact was heated to about 800° C., and upsetting forging was performed thereon at a processing rate of 70% and a stroke speed of 15 mm/s (a strain rate of about 1/s). The applied stress during the upsetting forging was 100 MPa.

Further, a second processing method of the hot deformation processing was forward extrusion. In this processing, each of the sintered compacts was heated to about 800° C. by a high-frequency, coil, the sintered compact heated to about 800° C. using a resistance heating method was filled into a mold, and forward extrusion was performed thereon at a processing rate of 70% and a stroke speed of 20 mm/s (a strain rate of about 1/s). The applied stress during the forward extrusion was 250 MPa.

Furthermore, a third processing method of the hot deformation processing was backward extrusion. In this processing, each of the sintered compacts was put into a mold, and the mold was heated by a high-frequency coil. Due to heat transfer from the mold, the sintered compact was heated to about 800° C., and backward extrusion was performed thereon at a processing rate of 70% and a stroke speed of 25 mm/s (a strain rate of about 1/s). The applied stress during the backward extrusion was 500 MPa.

In this way, the stress intensity applied to the sintered compacts varied depending on the respective hot deformation processing methods. The results are shown in FIG. 9.

Figure 9:
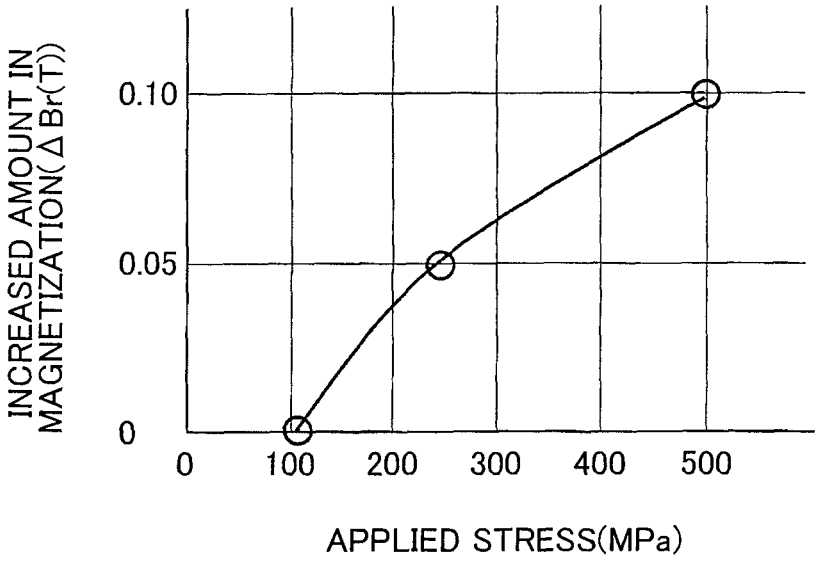
FIG. 9 is a diagram illustrating the results of an experiment for specifying a relationship between a stress applied during hot deformation processing and an increased amount in magnetization (an increased amount of the test piece having a nitrogen content of 2,000 ppm compared to the test piece having a nitrogen content of 200 ppm).

From FIG. 9, the following was found: an increased amount in remanent magnetization increases in order of upsetting (applied stress: 100 MPa), forward extrusion (applied stress: 250 MPa), and backward extrusion (applied stress: 500 MPa); and it is preferable that the hot deformation processing be forward or backward extrusion in order to apply a high stress.

Hereinabove, the embodiment of the invention has been described with reference to the drawings. However, a specific configuration is not limited to the embodiment, and design changes and the like which are made within a range not departing from the scope of the invention are included in the invention.

The invention claimed is:

1. A method of manufacturing a rare earth magnet comprising:

preparing a powder by preparing a rapidly-solidified ribbon by liquid solidification, and by crushing the rapidly-solidified ribbon to obtain a crushed powder, the rapidly-solidified ribbon being a plurality of fine crystal grains, the powder including a RE-Fe—B main phase and a grain boundary phase of a RE-X alloy present around the main phase, RE representing at least one of Nd and Pr, and X representing a metal element;

manufacturing a sintered compact including by press-forming the powder; and manufacturing a rare earth magnet by performing hot deformation processing on the sintered compact to impart anisotropy to the sintered compact, wherein a nitrogen content in the powder is adjusted to be at least 1,000 ppm and less than 3,000 ppm by performing at least one of the preparation of the powder and the manufacturing of the sintered compact in a nitrogen atmosphere, wherein a grain size of the crushed powder is adjusted to be in a range of 75 μm to 300 μm, an average grain size of the main phase constituting the sintered compact is adjusted to be 300 nm or less, and a content ratio of RE in the RE-Fe—B main phase is 29 mass % to 32 mass %.

2. The method according to claim 1, wherein the nitrogen content in the powder is adjusted to be in a range of 1,000 ppm to 2,500 ppm.

* * * * *